US010475386B2

(12) United States Patent
Kim

(10) Patent No.: US 10,475,386 B2
(45) Date of Patent: Nov. 12, 2019

(54) DISPLAY PANEL AND ELECTROLUMINESCENCE DISPLAY USING THE SAME

(71) Applicant: LG DISPLAY CO., LTD., Seoul (KR)

(72) Inventor: Kyujin Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 139 days.

(21) Appl. No.: 15/856,945

(22) Filed: Dec. 28, 2017

(65) Prior Publication Data

US 2019/0005883 A1 Jan. 3, 2019

(30) Foreign Application Priority Data

Jun. 30, 2017 (KR) ..... 10-2017-0083267

(51) Int. Cl.

| | |
|---|---|
| ***G09G 3/30*** | (2006.01) |
| ***G09G 3/3258*** | (2016.01) |
| ***G09G 3/3266*** | (2016.01) |
| ***G09G 3/3233*** | (2016.01) |
| *G09G 3/3275* | (2016.01) |

(52) U.S. Cl.

CPC ..... *G09G 3/3258* (2013.01); *G09G 3/3233* (2013.01); *G09G 3/3266* (2013.01); *G09G 3/3275* (2013.01); *G09G 2300/0814* (2013.01); *G09G 2300/0819* (2013.01); *G09G 2310/0289* (2013.01); *G09G 2310/0291* (2013.01); *G09G 2310/0294* (2013.01); *G09G 2310/061* (2013.01); *G09G 2320/0204* (2013.01); *G09G 2320/0295* (2013.01); *G09G 2320/045* (2013.01)

(58) Field of Classification Search

CPC ..... G09G 3/30–3291; G09G 2330/00–12

See application file for complete search history.

(56) References Cited

U.S. PATENT DOCUMENTS

| | | | | |
|---|---|---|---|---|
| 2011/0007067 | A1 | 1/2011 | Ryu et al. | |
| 2011/0018858 | A1 | 1/2011 | Ryu et al. | |
| 2013/0342114 | A1* | 12/2013 | Lee | G09G 3/3291 315/169.3 |
| 2017/0162119 | A1 | 6/2017 | Kim et al. | |

(Continued)

FOREIGN PATENT DOCUMENTS

| | | | |
|---|---|---|---|
| JP | 2009-53647 | A | 3/2009 |
| JP | 2009-216801 | A | 9/2009 |
| JP | 2011-164135 | A | 8/2011 |

(Continued)

*Primary Examiner* — Sanghyuk Park

(74) *Attorney, Agent, or Firm* — Seed Intellectual Property Law Group LLP

(57) ABSTRACT

The disclosure relates to display panel and electroluminescence display using the same. The display panel includes: a sub-pixel, which comprises a light-emitting element and a driving element for driving the light-emitting element, the light-emitting element emitting light by a current in the driving element during a driving phase; and a power switching circuit configured to supply a first driving voltage to the sub-pixel during the driving phase in an active period and a blanking interval, and supply a second driving voltage to the sub-pixel during a data writing phase of the active period and during resetting, sensing, and data writing phases of the blanking interval.

12 Claims, 20 Drawing Sheets

(56) References Cited

U.S. PATENT DOCUMENTS

| | | | | |
|---|---|---|---|---|
| 2017/0322608 | A1* | 11/2017 | Lee | G06F 1/26 |
| 2018/0239488 | A1* | 8/2018 | Lin | G06F 3/0416 |

FOREIGN PATENT DOCUMENTS

| | | | |
|---|---|---|---|
| JP | 2014-115539 | A | 6/2014 |
| JP | 2016-9156 | A | 1/2016 |
| KR | 10-2007-0027861 | A | 3/2007 |
| KR | 10-2014-0087591 | A | 7/2014 |
| KR | 10-2017-0026972 | A | 3/2017 |
| TW | I508045 | B | 11/2015 |
| WO | 2011/125107 | A1 | 10/2011 |

* cited by examiner

<Reset phase>

<Sensing phase>

DISPLAY PANEL AND ELECTROLUMINESCENCE DISPLAY USING THE SAME

CROSS-REFERENCE TO RELATED APPLICATIONS

This application claims the priority benefit of Korean Patent Application No. 10-2017-0083267 filed on Jun. 30, 2017, which is hereby incorporated herein by reference for all purposes as if fully set forth herein.

BACKGROUND

Technical Field

The present disclosure relates to a display panel that can compensate in real time for variations in the electrical characteristics of the driving elements in individual pixels and an electroluminescence display using the same.

Description of the Related Art

Electroluminescence displays are roughly classified into inorganic light-emitting displays and organic light-emitting displays depending on the material of an emission layer. Of these, an active-matrix organic light emitting display comprises organic light-emitting diodes (hereinafter, "OLED"), which are typical light-emitting diodes that emit light themselves, and has the advantages of fast response time, high luminous efficiency, high brightness, and wide viewing angle.

Each pixel of an organic light-emitting display comprises an OLED, a capacitor, a driving element, a switching element, etc. The driving element and the switching element may be implemented by MOSFET (metal oxide semiconductor field effect transistor) TFTs (thin-film transistors). The driving element adjusts the brightness of the pixel according to data of an image by regulating the current in the OLED by the gate-source voltage which varies with the gray level of the image data.

When the transistor used as the driving element operates in a saturation region, a drive current Ids flowing between the drain and source of the driving element is expressed as follows:

$$Ids=\tfrac{1}{2}*(\mu*C*W/L)*(Vgs-Vth)^2$$

where μ is electron mobility, C is the capacitance of a gate insulating film, W is the channel width of the driving element, and L is the channel length of the driving element. Vg is the gate-source voltage of the driving element, and Vth is the threshold voltage (or critical voltage) of the driving element. The gate-source voltage Vgs of the driving TFT is programmed (or set) according to a data voltage. The drain-source current Ids of the driving element flowing to the OLED is determined according to the programmed gate-source voltage Vgs.

Ideally, the electrical characteristics of the driving element, such as threshold voltage Vth, the electron mobility μ of the driving TFT, and the threshold voltage of the OLED, should be the same for every pixel since they serve as a factor for determining the current in the OLED. However, the electrical characteristics may vary between pixels, due to various causes including process variation, temporal change, etc. Such variations in the electrical characteristics of pixels may cause a decline in picture quality and a decrease in lifespan.

To compensate for variations in the electrical characteristics of the driving element, internal compensation and external compensation may be applied. In the internal compensation method, variations in the electrical characteristics of the driving element may be compensated for every pixel in real time. In the external compensation method, variations in the electrical characteristics of the driving elements of pixels are compensated for by sensing the driving voltage of each pixel and modulating data of an input image by an external circuit based on the sensed voltage.

However, the conventional internal and external compensation methods have the problem of IR drop effect. The IR drop causes a drop in the drive voltage of a pixel which occurs when current I flows through a resistor R. This voltage drop varies with the position on the screen. Due to this, there may be differences in brightness between pixels depending on the position on the screen of the display panel.

BRIEF SUMMARY

The present disclosure has been made in an effort to provide a display panel that can compensate for variations in the electrical characteristics of the driving elements in individual pixels and minimize the effect of voltage drop on the power applied to pixels According to an embodiment, a display panel is provided, which displays frame data during a frame period including an active period and a blanking interval, and modulates data of an input image based on a result of sensing electrical characteristics of pixels in the blanking interval, the display panel comprising: a sub-pixel that includes a light-emitting element and a driving element configured to drive the light-emitting element to emit light based on a current in the driving element during a driving phase; and a power switching circuit configured to supply a first driving voltage to the sub-pixel during the driving phase in the active period and the blanking interval, and supply a second driving voltage to the sub-pixel during a data writing phase of the active period and during resetting, sensing, and data writing phases of the blanking interval.

According to another embodiment, an electroluminescence display is provided, which includes a display panel according to the embodiments of the disclosure.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
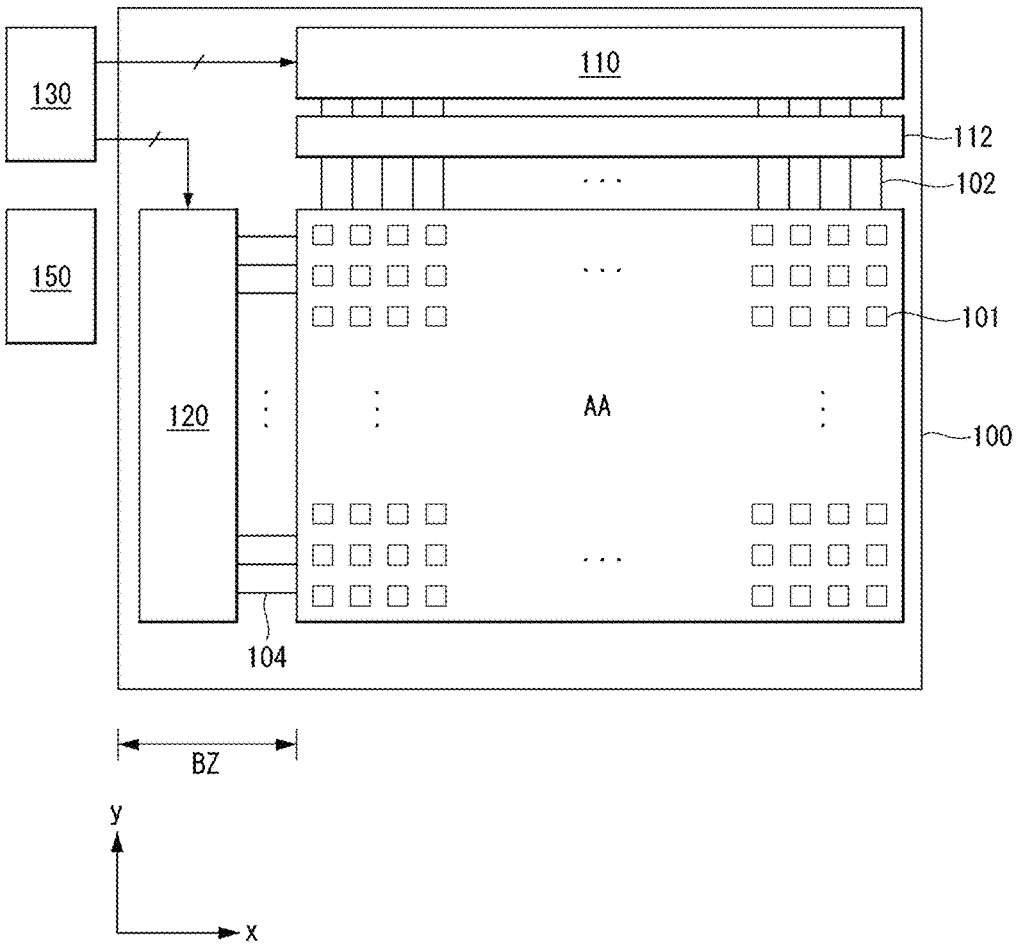
FIG. 1 is a block diagram showing an electroluminescence display according to an exemplary embodiment of the present disclosure.

Various aspects and features of the present disclosure and methods of accomplishing them may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure.

When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, the functions or structures of these elements should not be limited by these terms.

The features of various exemplary embodiments of the present disclosure may be coupled or combined with one another either partly or wholly, and may technically interact or work together in various ways. The exemplary embodiments may be carried out independently or in connection with one another.

In an electroluminescence display of the present disclosure, a pixel circuit may comprise one or more of an n-type TFT (NMOS) and a p-type TFT (PMOS). A TFT is a three-electrode device with gate, source, and drain. The source is an electrode that provides carriers to the transistor. The carriers in the TFT flow from the source. The drain is an electrode where the carriers leave the TFT. That is, the carriers in the TFT flow from the source to the drain. In the case of the n-type TFT, the carriers are electrons, and thus the source voltage is lower than the drain voltage so that the electrons flow from the source to the drain. In the n-type TFT, current flows from the drain to the source. In the case of the p-type TFT (PMOS), the carriers are holes, and thus the source voltage is higher than the drain voltage so that the holes flow from the source to the drain. In the p-type TFT, since the holes flow from the source to the drain, current flows from the source to the drain. It should be noted that the source and drain of the TFT are not fixed in position. For example, the source and drain are interchangeable depending on the applied voltage. Accordingly, the disclosure should not be limited by the source and drain of the TFT. In the following description, the source and drain of the TFT will be referred to as first and second electrodes.

A gate signal applied to the pixel circuit swings between gate-on voltage and gate-off voltage. The gate-on voltage is set higher than the threshold voltage of the TFT, and the gate-off voltage is set lower than the threshold voltage of the TFT. The TFT turns on in response to the gate-on voltage and turns off in response to the gate-off voltage. In the n-type TFT, the gate-on voltage may be gate-high voltage VGH, and the gate-off voltage may be gate-low voltage VGL. In the p-type TFT, the gate-on voltage may be gate-low voltage VGL, and the gate-off voltage may be gate-high voltage VGH.

Hereinafter, various exemplary embodiments of the present disclosure will be described in detail with reference to the drawings. The following exemplary embodiments will be described with respect to an organic light-emitting display comprising an organic light-emitting material. However, the technical idea of the present disclosure is not limited to the organic light-emitting display, but also may be applied to an inorganic light-emitting display comprising an inorganic light-emitting material. An example of the inorganic light-emitting display may include, but not limited to, a quantum dot display.

Figure 2:
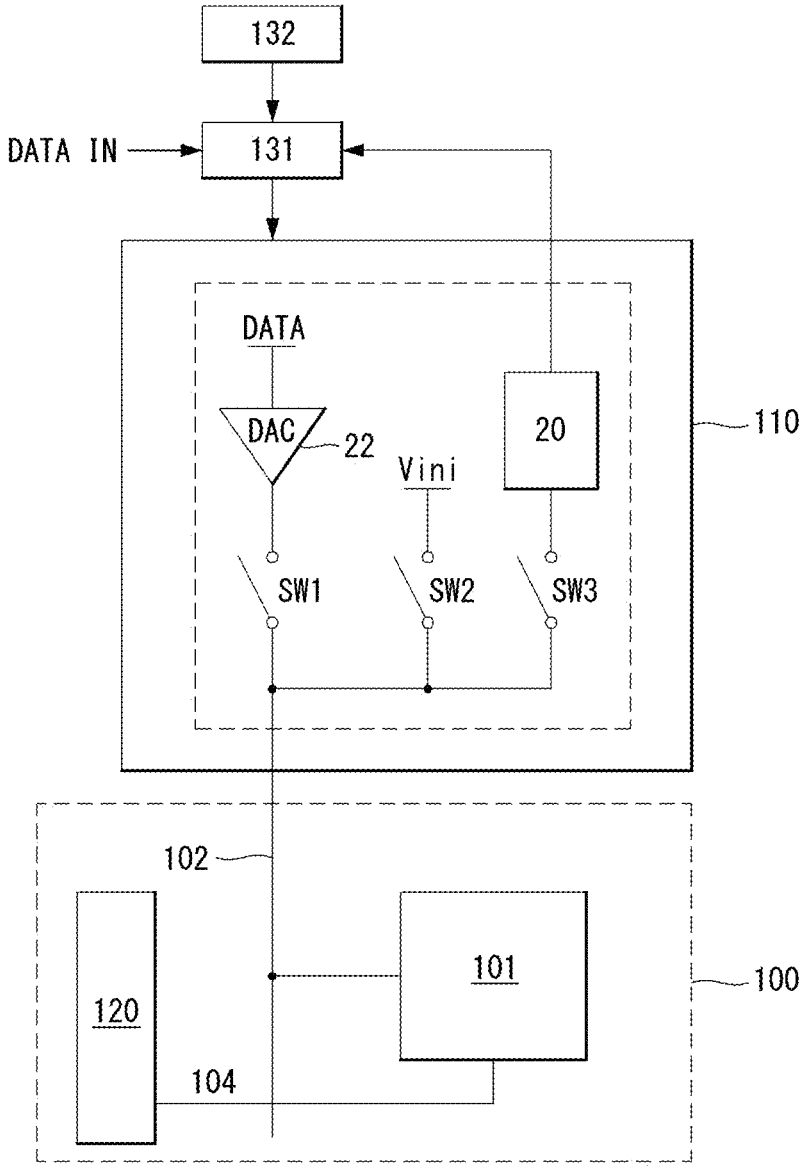
FIG. 2 is a circuit diagram of an external compensation circuit according to an exemplary embodiment of the present disclosure.
Figure 3:
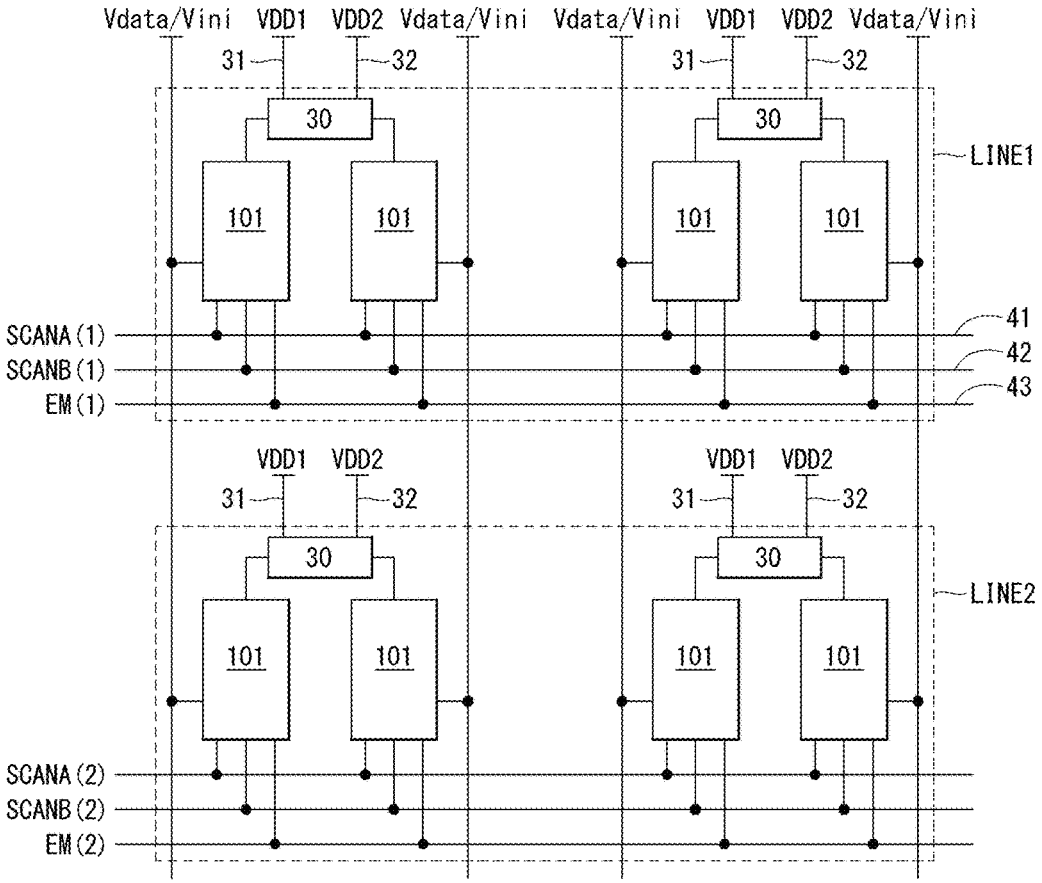
FIG. 3 is a view showing part of a pixel array.

FIG. 1 is a block diagram showing an electroluminescence display according to an exemplary embodiment of the present disclosure. FIG. 2 is a circuit diagram of an external compensation circuit according to an exemplary embodiment of the present disclosure. FIG. 3 is a view showing part of a pixel array.

Referring to FIGS. 1 and 2, an electroluminescence display according to an exemplary embodiment of the present disclosure comprises a display panel 100 and a display panel drive circuit.

The display panel 100 comprises an active area AA that displays an input image on the screen. A pixel array is arranged in the active area AA. The pixel array comprises signal lines and pixels. The signal lines comprise data lines 102 and gate lines 104 intersecting the data lines 102. Power wires and electrodes for supplying power such as VDD, Vini, and VSS to the pixels may be arranged in the pixel array. The pixels comprise pixels that are arranged in a matrix. In FIG. 3, LINE1 and LINE2 represent pixel lines. The pixel lines LINE1 and LINE2 each comprise 1 line of pixels in the pixel array that shares gate lines.

Each pixel may be divided into a red sub-pixel, a green sub-pixel, and a blue sub-pixel for color representation. Each pixel may further comprise a white sub-pixel. Each sub-pixel 101 comprises a pixel circuit. The pixel circuit comprises a light-emitting element, a driving element, a plurality of switching elements, and a capacitor. The pixel circuit comprises a compensation circuit that is capable of compensating for variations in the electrical characteristics of the driving elements in individual pixels in real time by using the switching elements. The driving element and the switching elements may be implemented by, but not limited to, a PMOS TFT.

The display panel 100 may further comprise VDD line for supplying a pixel driving voltage VDD to sub-pixels 101, Vini wiring for supplying a reset voltage Vini to the sub-pixels 101 to reset the pixel circuit, VSS wiring and VSS electrodes for supplying a low-potential power supply voltage VSS to the sub-pixels 101, VGH wiring to which VGH is applied, VGL wiring to which VGL is applied, and so on. The VDD line is divided into first VDD line 31 to which VDD1 is applied and second VDD line 32 to which VDD2 is applied.

Power supply voltages such as VDD, Vini, and VSS are generated from a power circuit 150. The power circuit 150 generates power required for driving the pixels by using a DC-DC converter, a charge pump, a regulator, etc. The power circuit 150 may be implemented as, but not limited to, a PMIC (power module integrated circuit). The power supply voltages may be set to, but not limited to, VDD=VDD1=VDD2=4.5 V, VSS=−2.5 V, Vini=−3.5 V, VGH=7.0 V, and VGL=−5.5 V. The power supply voltages may vary depending on the driving characteristics or model of the display panel 100.

Touch sensors (not shown) may be placed on the screen of the display panel 100. Touch input may be sensed using touch sensors or through the pixels. The touch sensors may be implemented as on-cell type or add-on type touch sensors which are placed on the screen of the display panel, or as in-cell type touch sensors embedded in the pixel array.

The display panel drive circuit comprises a data driver 110, a gate driver 120, VDD switching circuits 30, etc. The display panel drive circuit may further comprise a demultiplexer 112 placed between the data driver 110 and the data lines 102.

The display panel drive circuit writes data of an input image to the pixels of the display panel 100 under control of a timing controller (TCON) 130. The display panel drive circuit may further comprise a touch sensor driver for driving the touch sensors. The touch sensor driver is omitted in FIG. 1. In a mobile device, the display panel drive circuit, timing controller 130, and power circuit 150 may be integrated in a single integrated circuit.

Neighboring sub-pixels 101 on the same pixel line are connected in common to a VDD switching circuit 30. This means that neighboring sub-pixels share a single VDD switching circuit 30. The VDD switching circuit 30 supplies VDD1 to the sub-pixels 101 during a driving phase of an active period AT (see FIG. 22), and supplies VDD2 to the sub-pixels 101 during a data writing phase of the active period and during reset and sensing phases of a vertical blanking interval VB (see FIG. 22). The VDD switching circuit 30 may be also referred to herein as power switching circuit 30.

The active period is the time when 1 frame of data is written to all the pixels on the screen. The vertical blanking interval is a given period of time between an (N−1)th active period and an Nth active period. During the vertical blanking interval, the next frame data (Nth frame data) is not received by the timing controller 130.

The driving phase is the time when VDD1 is supplied to the driving element and a current Ids generated by the gate-source voltage Vgs of the driving element flows to the light-emitting diode. In the driving phase, the light-emitting element of the sub-pixel may emit light.

The data writing phase is the time when VDD2 is supplied to a first electrode of the storage capacitor Cst and a data voltage Vdata generated from the data driver 110 is applied to a second electrode of the storage capacitor Cst and a gate of the driving element.

The sensing phase is allocated within the vertical blanking interval. The reset phase for resetting the sub-pixels comes before the sensing phase. In the sensing phase, the electrical characteristics of the sub-pixels, for example, the threshold voltage of the driving elements, are sensed.

The display panel drive circuit writes data of the current frame to all the sub-pixels in each active period. The display panel drive circuit senses the electrical characteristics of the driving elements of sub-pixels on a preset pixel line in the vertical blanking interval, and re-writes (N−1)th frame data, i.e., previous frame data, to the sensed sub-pixels. One or more pixel lines may be sensed in the vertical blanking interval, and then other pixel lines may be sensed in the next vertical blanking interval.

The display panel drive circuit may operate in slow driving mode. In slow driving mode, an input image is analyzed, and if the input image does not change for a preset period of time, the power consumption of the display device is reduced. In slow driving mode, when a still image is on for more than a certain amount of time, the intervals at which data is written to the pixels is lengthened by decreasing the refresh rate (or frame rate) of the pixels, thereby reducing power consumption. Slow driving mode is not limited to when a still image is input. For instance, when the display device operates in standby mode or no user command or input image is input into the display panel drive circuit for more than a given amount of time, the display panel drive circuit may operate in slow driving mode.

The data driver 110 converts data signals (digital data) of an input image, received from the timing controller 130 for each frame, to analog data voltages by means of a digital-to-analog converter (DAC) 22. The timing controller 130 transmits compensation data modulated by a compensation part 131 to the data driver 110. Data voltages Vdata output from the data driver 110 are supplied to the data lines 102 through the demultiplexer 112. The data driver 110 may comprise a sensing part 20 shown in FIG. 2.

The demultiplexer 112 is placed between the data driver 110 and the data lines 102 and distributes the data voltages Vdata output from the data driver 110 to the data lines 102. Because of the demultiplexer 112, the number of output channels for the data driver 110 can be reduced to half the number of data lines.

The gate driver 120 outputs gate signals to the gate lines 104 under control of the timing controller 130. The gate driver 120 may sequentially supply the gate signals to the gate lines 104 by shifting the signals by a shift register. The gate signals comprise scan signals SCANA(1) to SCANB(2) for selecting a line of pixels to which data is to be written, and emission switching signals (hereinafter, "EM signals") EM(1) and EM(2) defining the emission time of pixels charged with data voltages. In FIG. 3, SCANA(1), SCANB (1), and EM(1) are gate signals supplied to the sub-pixels 101 of the first pixel line LINE1. SCANA(2), SCANB(2), and EM(2) are gate signals supplied to the sub-pixels 101 of the second pixel line LINE2. The gate lines 104 comprise a first gate line 41 to which the first scan signals SCANA(1) and SCANA(2) are applied, a second gate line 42 to which SCANB(1) and SCANB(2) are applied, and a third gate line 43 to which the EM signals EM(1) and EM(2) are applied.

The pixel circuits of the sub-pixels, the demultiplexer 112, the gate driver 120, and a power switching circuit 30 may be formed directly on a substrate of the display panel 100 using the same fabrication process. The transistors of the pixel circuits, demultiplexer 112, gate driver 120, and power switching circuit 30 may be implemented as NMOS or PMOS transistors, or as transistors of the same type.

The timing controller 130 receives digital data of an input image and timing signals synchronized with the digital data from a host system (not shown). The timing signals comprise a vertical synchronization signal Vsync, a horizontal synchronization signal Hsync, a clock signal DCLK, and a data enable signal DE. The host system may be any one of the following: a TV (television) system, a set-top box, a navigation system, a personal computer PC, a home theater system, and a mobile device's system.

The timing controller 130 selects a compensation value based on a sub-pixel sensing result received in the vertical blanking interval, and modulates the input image's digital data by this compensation value and transmits it to the data driver 110. Accordingly, the data driver 110 converts the data modulated based on the sub-pixel sensing result to data voltages by the DAC 22 and outputs them to the data lines 102.

The timing controller 130 may control the operation timing of the display panel drivers 110, 112, 120, and 30 by multiplying the input frame frequency (Hz) by i times (i is a positive integer greater than 0). The input frame frequency is 60 Hz in the NTSC (National Television Standards Committee) system and 50 Hz in the PAL (Phase-Alternating Line) system. In slow driving mode, the timing controller 130 may decrease the frame frequency to a frequency of 1 to 30 Hz in order to reduce the refresh rate of the pixels.

The timing controller 130 controls the operation timing of the display panel drive circuit by generating a data timing control signal for controlling the data driver 110, a switch control signal for controlling the demultiplexer 112, and a gate timing control signal for controlling the gate driver 120 based on the timing signals Vsync, Hsync, and DE received from the host system. The gate timing control signal output from the timing controller 130 may be converted to gate-on voltage or gate-off voltage through a level shifter and supplied to the gate driver 120. The level shifter converts the low-level voltage of the gate timing control signal to gate-low voltage VGL and converts the high-level voltage of the gate timing control signal to gate-high voltage VGH.

The gate driver 120 may be formed in a bezel area BZ outside the active area AA. The VDD switching circuits 30 may be formed in the bezel area BZ or distributed within the active area AA.

A look-up table is created before product shipment by sensing the electrical characteristics of each pixel and deriving a compensation value for compensating for variations in the electrical characteristics of the sub-pixels based on a sensing result. This compensation value may be divided into a compensation value (offset) for compensating the threshold voltage of the driving elements and a compensation value (gain) for compensating the mobility of the driving elements. A look-up table of compensation values is stored on memory 132. The memory 132 may be, but not limited to, flash memory.

When power is applied to the electroluminescence display, a compensation value from the memory 132 is transmitted to the memory of the compensation part 131 of the timing controller 130. The memory of the compensation part 131 may be, but not limited to, DDR SDRAM (double data rate synchronous dynamic RAM or SDRAM.

As shown in FIG. 2, the data driver 110 comprises a DAC 22, a sensing part 20, a first switching element SW1 disposed between an output terminal of the DAC 22 and a data line 102, a second switching element SW2 for supplying Vini to the data line 102, and a third switching element SW3 disposed between the data line 102 and an input terminal of the sensing part 20. The switching elements SW1, SW2, an SW3 may be turned on/off under control of the timing controller 130.

The first switching element SW1 may turn on in the active period and supply a data voltage Vdata output from the DAC 22 to the data line 102. The first switching element SW1 is kept in the off state during the vertical blanking interval.

The second switching element SW2 supplies Vini to the data line 102 in the reset phase of the vertical blanking interval. The third switching element SW3 turns on in the sensing phase of the vertical blanking interval to connect the data line 102 to the sensing part 20. The second and third switching elements SW2 and SW3 are kept in the off state during the active period.

The sensing part 20 senses the electrical characteristics of the sub-pixels, e.g., the threshold voltage of the driving elements, in the vertical blanking interval in real time for each frame. The sensing part 20 converts a sub-pixel sensing result to digital data by means of an analog-to-digital converter (hereinafter, "ADC") and transmits it to the compensation part 131. The sensing part 20 may be implemented as a well-known voltage sensing circuit or current sensing circuit.

The compensation part 131 enters a sub-pixel sensing result received from the sensing part 20 into the look-up table, selects a compensation value based on the sensing result, and modulates the input image's data by the compensation value and outputs compensated data. A compensation value for compensating the threshold voltage of the driving elements may be added to the input image's data, and a compensation value for compensating the mobility of the driving elements may be multiplied by the input image's data. The compensation data output from the compensation part 131 is transmitted to the data driver 110. Thus, the electroluminescence display according to the present disclosure may compensate for variations in the electrical characteristics of sub-pixels in real time by sensing the electrical characteristics of the sub-pixels in real time in the vertical blanking period for each frame and compensating the input image's data based on the sensing result.

IR drop, which affects pixels, will be described in connection with FIGS. 4 to 10.

Figure 4:
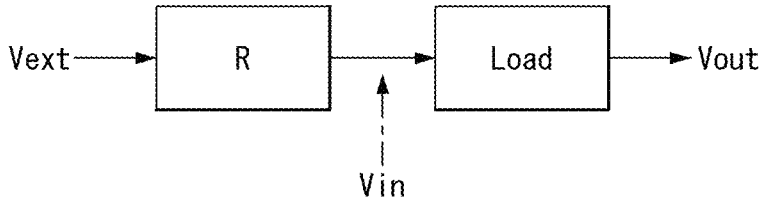
FIG. 4 is a view showing a voltage drop caused by IR drop.

As shown in FIG. 4, the IR drop refers to a voltage drop which occurs when current I flows through resistance R. In FIG. 4, Vext is an external input voltage, and Vin is an actual input voltage supplied to a load. Vout is an output voltage Vout that has passed through the load. The actual input voltage Vin is Vin=Vext-IR.

Figure 5:
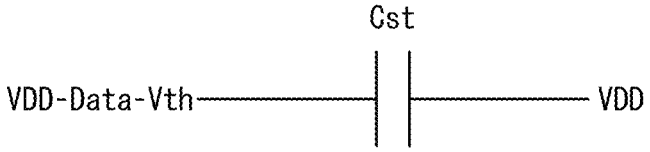
FIG. 5 is a view showing voltages applied to two ends of the capacitor of a sub-pixel.

A pixel circuit comprises a storage capacitor Cst that stores the gate-source voltage of the driving element. As shown in FIG. 5, VDD is applied to the first electrode of the storage capacitor Cst, and VDD−Vgs=VDD-DATA-Vth is applied to the second electrode thereof. DATA is a voltage corresponding to a gray level of pixel/data in input image. Vgs is the gate-source voltage of the driving element, and Vth is the threshold voltage of the driving element.

Figure 6:
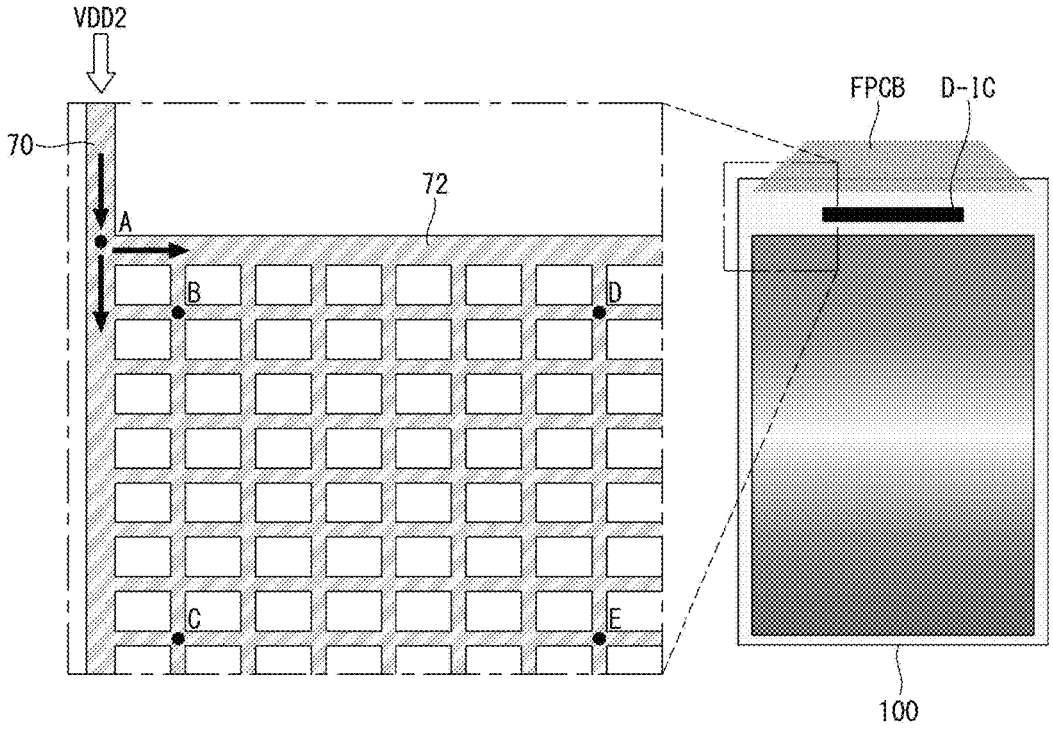
FIGS. 6 to 8 are enlarged views of part of LOG (Line On Glass, i.e., a wire formed on a glass substrate) line and second VDD line on a part of the display panel.
Figure 7:
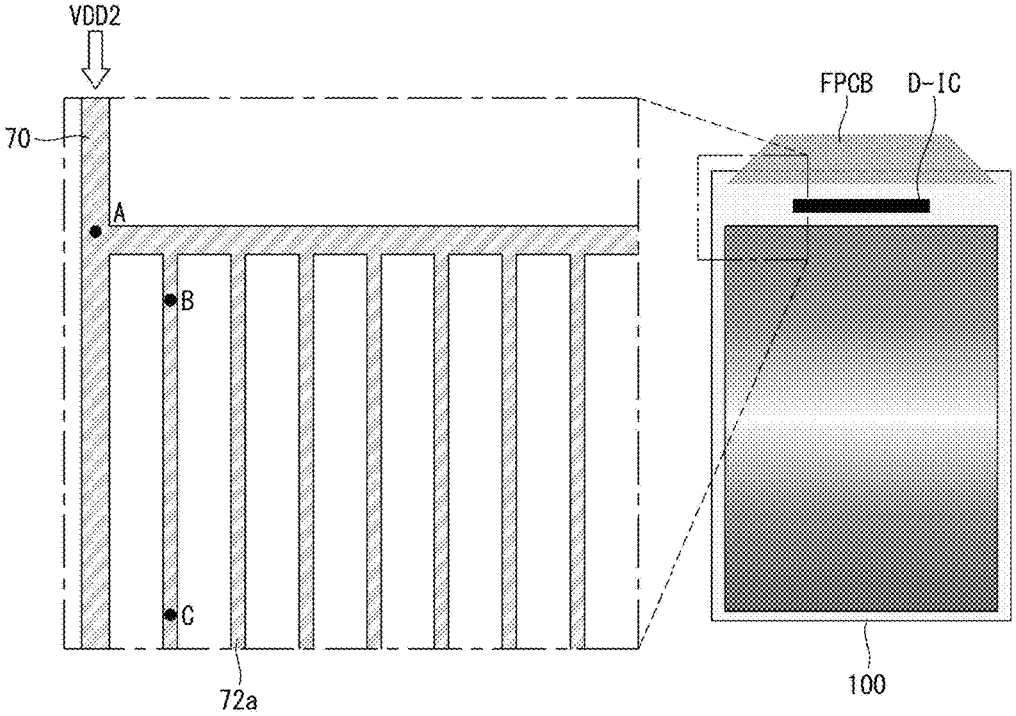
Figure 8:
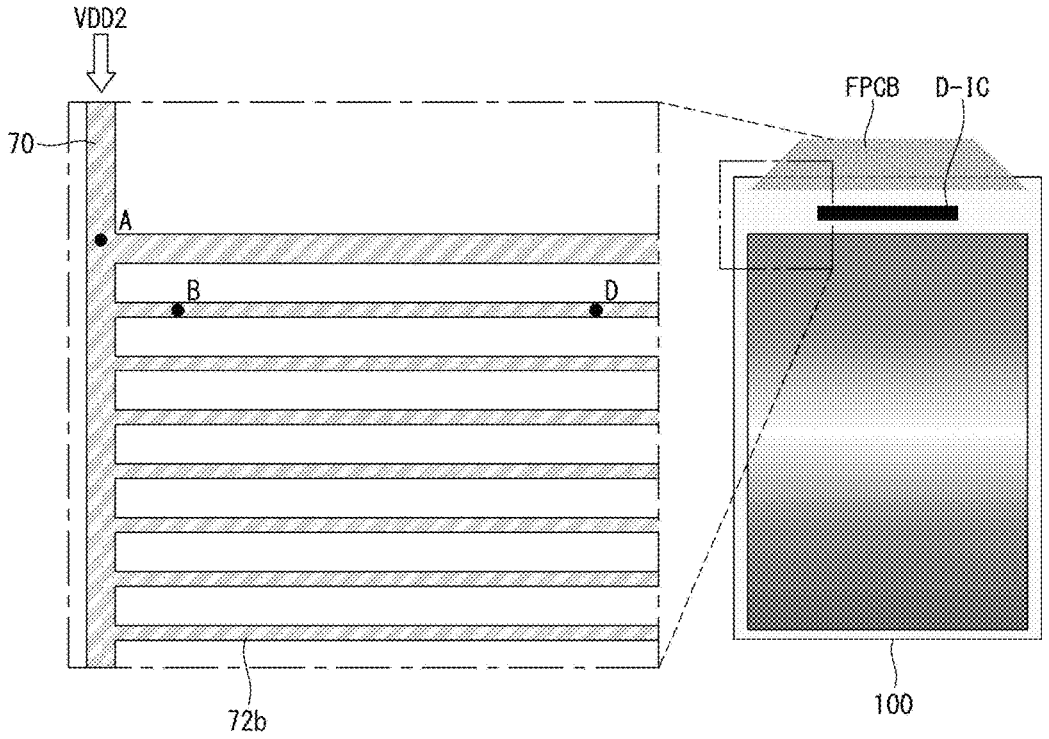

FIGS. 6 to 8 are views showing LOG line and VDD line on a part of the display panel 100. In FIGS. 6 to 8, "D-IC" represents a drive IC of a mobile device. A power circuit 150, a timing controller 130, a data driver 110, etc. may be integrated in the drive IC D-IC.

Referring to FIGS. 6 to 8, the VDD line in the display panel 100 comprises LOG line 70 that receives VDD from the power circuit 150 through a PCB (or FPCB), and mesh-like VDD line 72 connected to the LOG line 70. The resistance of the LOG lined 70 is higher than that of the VDD line 72.

Figure 9:
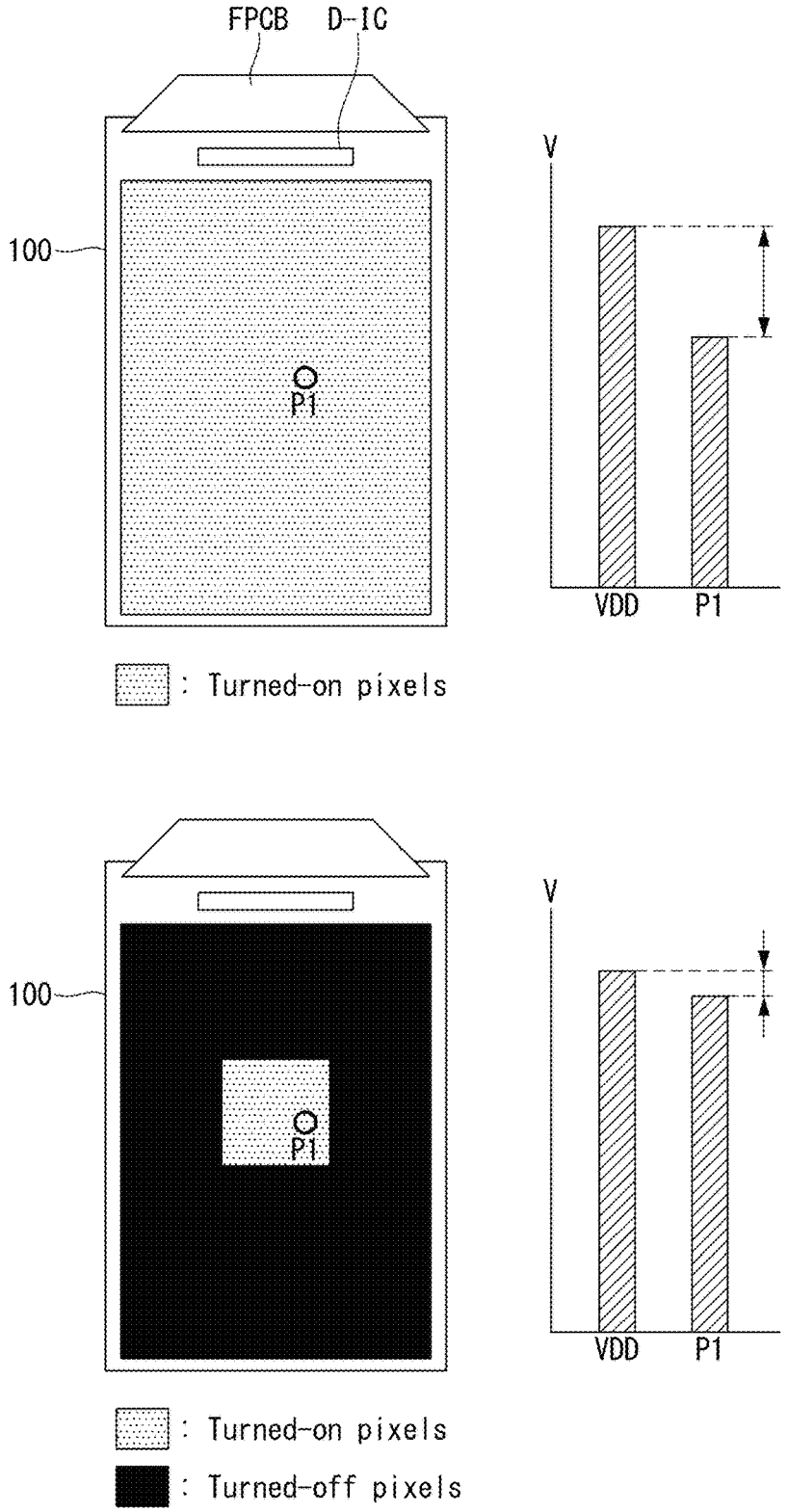
FIGS. 9 and 10 are views showing a voltage drop caused by IR drop on VDD line.
Figure 10:
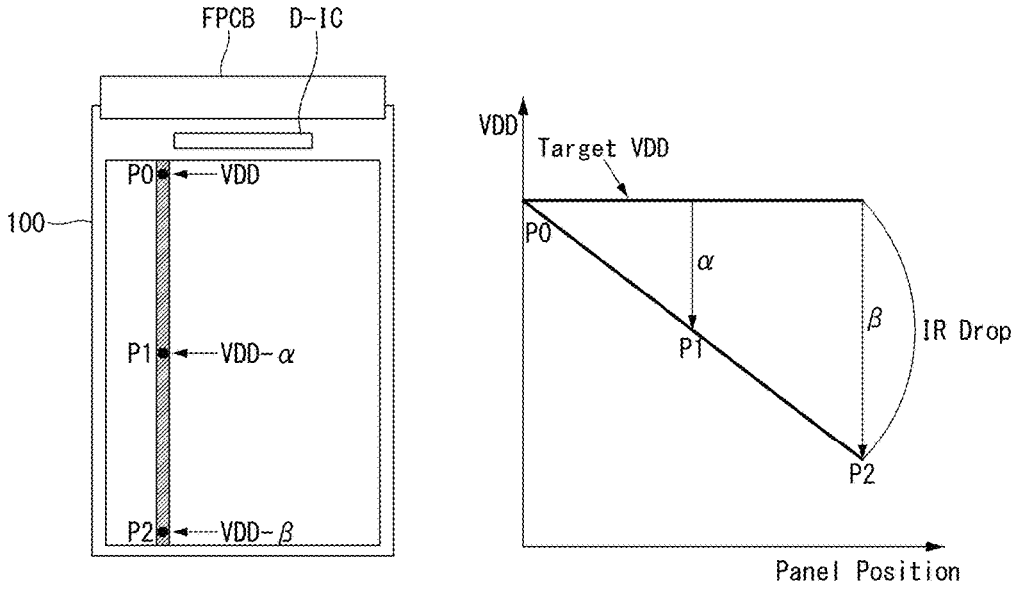

The VDD line 72 comprises vertical wires 72*a* shown in FIG. 7 and horizontal wires 72*b* shown in FIG. 8. The vertical wires 72*a* and the horizontal wires 72*b* intersect each other with an insulating layer in between and are connected together via contact holes passing through the insulating layer at at least some of the intersections. In FIGS. 8 to 10, the contact holes may be formed at positions B, C, D, and E.

An input IR drop occurs through the resistance of the LOG line. The voltage VDD may vary due to the input IR drop since the LOG line has high resistance. Provided that the current required for driving the pixels at positions B, C, D, and E is Ib, Ic, Id, and Ie, respectively, the current Ia at position A on the LOG lines is Ib+Ic+Id+Ie. Thus, the voltage at position A is Va=VDD−(Ra*Ia)=VDD−{Ra*(Ib+Ic+Id+Ie)}. Here, the IR drop is Ra*(Ib+Ic+Id+Ie). Ra is the resistance of the LOG line at position A. IR drop is a voltage that varies with the amount of current required for all the pixels, and the input IR drop is steeper than the IR drop on the VDD line 72 since the IR drop is a voltage that varies with the amount of current required for all the pixels The IR drop on the VDD line 72 may be divided into a vertical IR drop which occurs on the vertical wires 72*a* and a horizontal IR drop which occurs on the horizontal wires 72*b*. The vertical IR drop is an IR drop that appears on the vertical wires 72*a*, as shown in FIG. 7. In analyzing the vertical drop on the VDD line 72 excluding the horizontal wires 72*b*, the current flowing through position B equals the sum of the current Ib required at position B and the current Ic required at position C. The voltage Vb at position B is Vb=Va−{Rb*(Ib+Ic)}. Rb is the resistance at position B.

The horizontal IR drop is an IR drop that appears on the horizontal wires 72*b*, as shown in FIG. 8. In analyzing the horizontal drop on the VDD line 72 excluding the vertical wires 72*a*, the current flowing through position B equals the sum of the current Ib required at position B and the current Id required at position D. The voltage Vb at position B is Vb=Va−{Rb(Ib+Id)}.

In the electroluminescence display, the brightness of a pixel may vary, affected by IR drop in VDD that occurs on other pixels. For example, as shown in FIG. 9, when all the pixels are turned on at white level, the voltage drop in VDD applied to the turned-on pixel at position P1 is steeper. In contrast, when some of the pixels are turned on but most of the pixels are turned off, the voltage drop in VDD applied to the turned-on pixel at position P1 is relatively shallower.

A constant current has to flow to the light-emitting elements through the driving elements of the pixels, in order that all the pixels emit light with the same brightness at the same gray level. In the case of a high PPI (pixel per inch) model, the resistance of the VDD line is higher and the IR drop becomes steeper as it goes down to the lower positions P1 and P2 on the display panel 100, as shown in FIG. 10. The IR drop causes a voltage drop in VDD applied to the driving elements and elicits a change in the electrical current flowing through the light-emitting elements depending on the position on the display panel, which may result in non-uniform brightness.

When VDD is applied to the top position PO on the display panel 100, the IR drop causes VDD to drop to VDD-α at the middle position P1 and to further drop to VDD-β at the bottom position P2.

In the electroluminescence display of the present disclosure, VDD is divided into VDD=VDD1 for the driving phase and VDD=VDD2 for the sensing phase and data writing phase, and variations in the electrical characteristics of sub-pixels are compensated for by external compensation. In the present disclosure, when data is written to the sub-pixels in the active period and the electrical characteristics of the sub-pixels are sensed in the vertical blanking interval, VDD(=VDD2) is applied to the sub-pixels. Accordingly, the electroluminescence display of the present disclosure prevents variations in the gate-source voltage Vgs of the driving elements of individual sub-pixels without the effect of IR drop in the sensing and data writing phases, and is able to accurately sense the electrical characteristics of the driving elements of individual pixels since there is no effect of IR drop in the sensing phase. The electroluminescence display of the present disclosure can display images at uniform brightness across the screen by compensating for IR drop on the VDD line and compensating input image data based on a sub-pixel sensing result, without additional development of an algorithm or compensation circuit for compensating for IR drop.

Figure 11A:
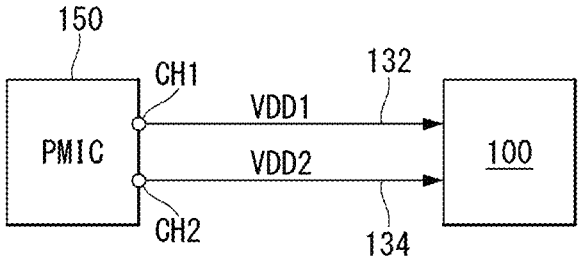
FIGS. 11A and 11B are views showing a VDD path between a power circuit and a display panel according to an exemplary embodiment of the present disclosure.
Figure 11B:
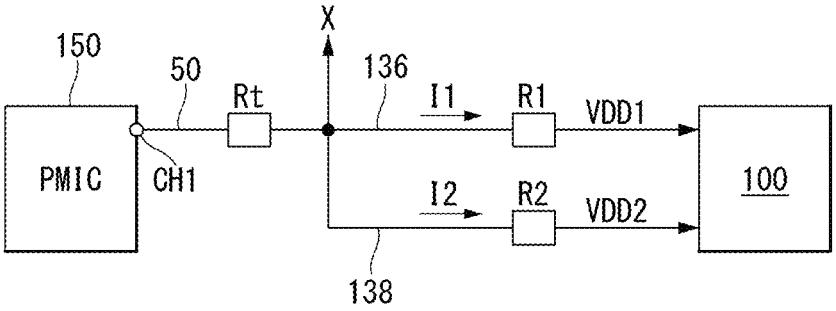

FIGS. 11A and 11B are views showing a VDD path between the power circuit 150 and the display panel 100 according to an exemplary embodiment of the present disclosure.

As shown in FIG. 11A, the power circuit 150 of the present disclosure may output VDD1 and VDD2 through separate output channels and supply them to the display panel 100. VDD1 is supplied through a first output terminal CH1 of the power circuit 150 and supplied to first VDD line 132 on a PCB. The first VDD line 132 on the PCB is connected to the first VDD line 31 on the display panel 100. VDD2 is supplied through a second output terminal CH2 of the power circuit 150 and supplied to second VDD line 134 on the PCB. The second VDD line 134 on the PCB is connected to the second VDD line 32 on the display panel 100. Although VDD1 and VDD2 may be output from the power circuit 150 at the same voltage level in the case of FIG. 11A, they also may be output at different levels. The voltages VDD1 and VDD2 may be determined depending on the driving characteristics or application of the display panel.

As shown in FIG. 11B, the power circuit 150 of the present disclosure may output VDD1 and VDD2 through a single channel and supply them to the display panel 100. VDD output through the first output terminal CH1 of the power circuit 150 is supplied to a single wire 50 on the PCB. The single wire 50 is divided into two branch wires 136 and 138. VDD applied to the first branch wire 136 is supplied to the first VDD line 31 on the display panel 100. VDD2 applied to the second branch wire 138 is supplied to the second VDD line 32 on the display panel 100.

The single input wire 50 in FIG. 11B should be designed to have minimum resistance. The current It flowing through the resistance Rt of the single input wire 50 is It=I1+I2. The voltage at node X equals (Vx)=Rt*It=Rt*(I1+I2). The current I1 flowing through the first branch wire 136 may cause a change in VDD1 supplied to the sub-pixels in the data writing and sensing phases. Due to this, the resistance Rt of the single input wire 50 should be set to less than 1% of the resistances R1 and R2 of the branch wires 46 and 48 so as to suppress changes in VDD2 caused by the current I1 through the branch wire I1 to less than 1%. However, the disclosure is not limited thereto.

Figure 12:
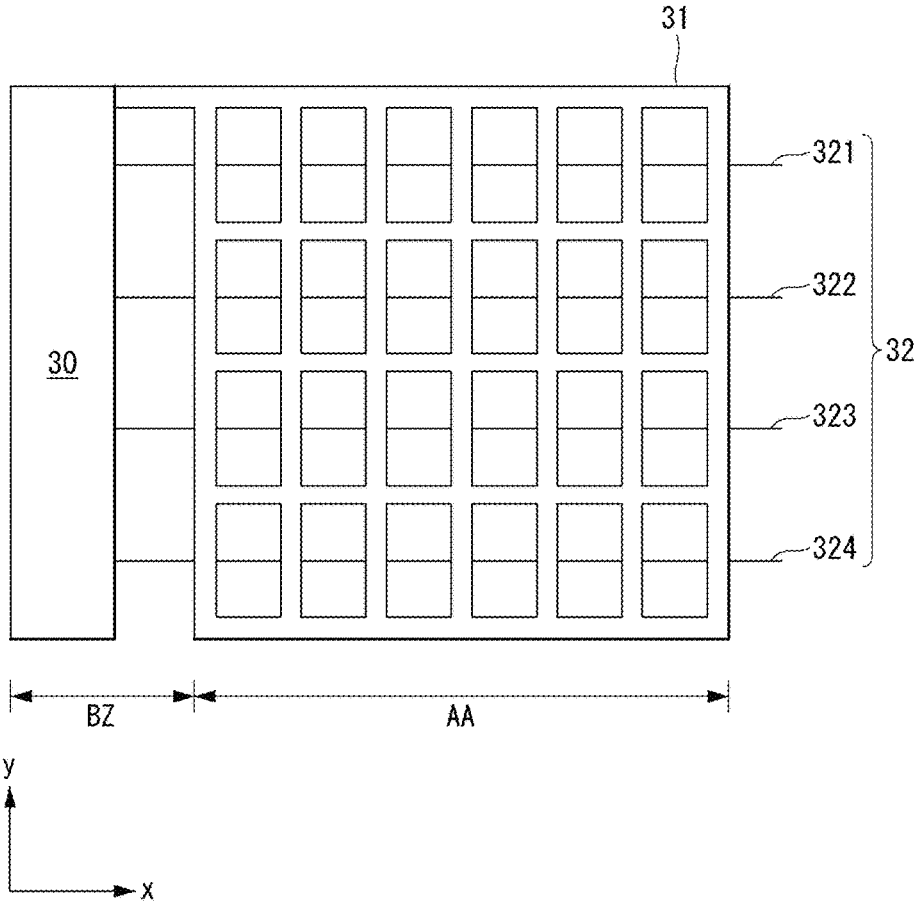
FIG. 12 is a view showing first and second VDD lines according to an exemplary embodiment of the present disclosure.

FIG. 12 is a view showing first and second VDD lines according to an exemplary embodiment of the present disclosure.

Referring to FIG. 12, the first VDD line 31 is formed in a mesh-like pattern on the pixel array in the active area AA where images are displayed, and connected to all the sub-pixels. The VDD switching circuit 30 connects the first VDD line 31, to which VDD1 is applied in the driving phase, to the sub-pixels. The VDD switching circuit 30 disconnects the second VDD line 32 from the sub-pixels in the driving phase.

The second VDD line 32 comprises a plurality of VDD lines 321 to 324 which are formed on individual pixel lines. The VDD lines 321 to 324 are separated between the pixel lines. In the data writing and sensing phases, the VDD switching circuit 30 connects sub-pixels 101 on a first pixel line to a 2-1 VDD line 321 to which VDD2 is applied. The VDD switching circuit 30 connects sub-pixels 101 on a second pixel line to a 2-2 VDD line 322 to which VDD2 is applied. In the data writing and sensing phases, the VDD switching circuit 30 sequentially connects the second VDD lines 321 to 324 to individual pixel lines one by one. The VDD switching circuit 30 disconnects the first VDD line 31 from the sub-pixels that operate in the data writing and sensing phases.

Figure 13:
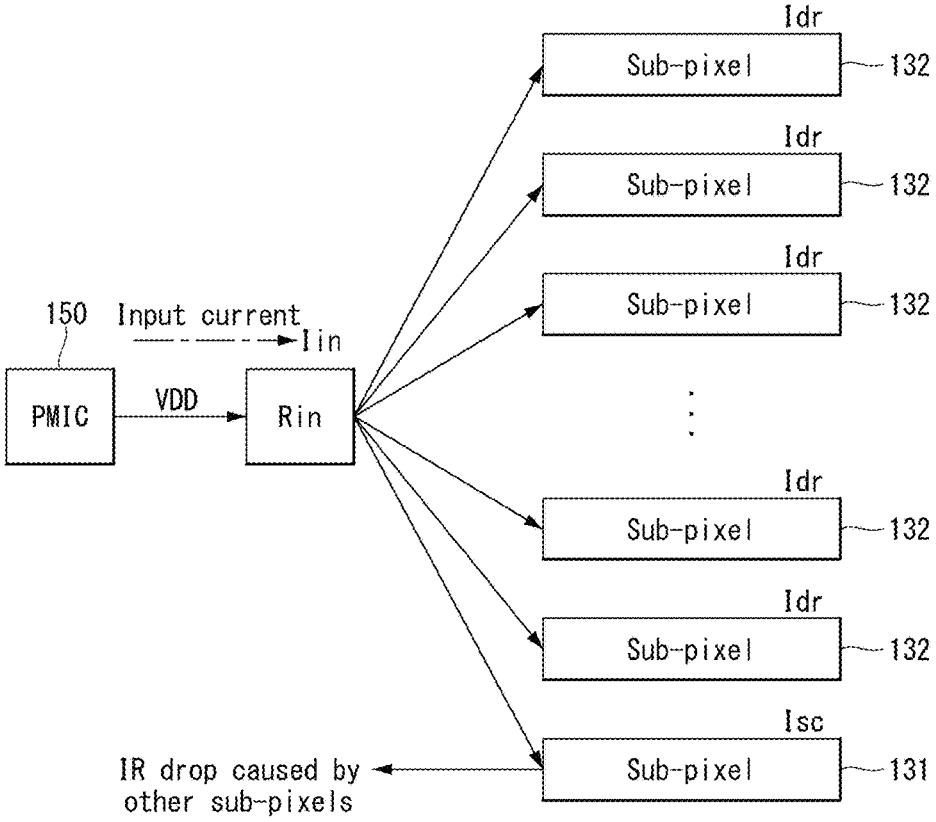
FIG. 13 is a view showing an example in which pixels on all pixel lines are driven by common VDD.
Figure 14:
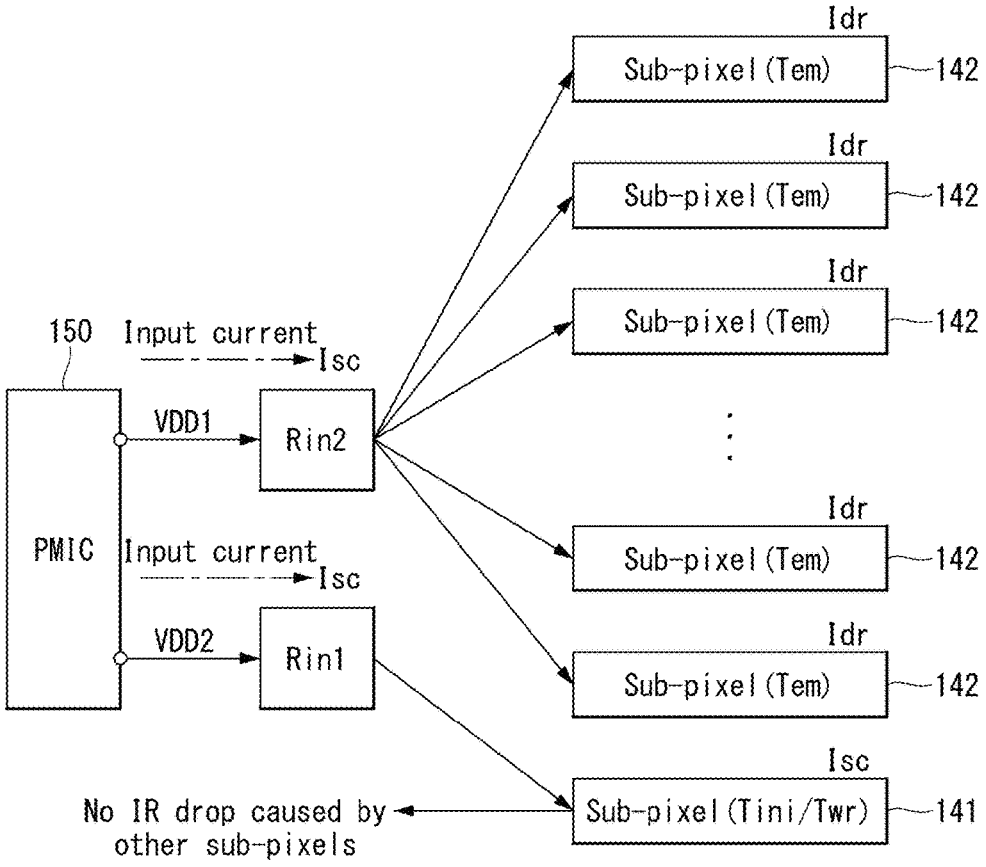
FIG. 14 is a view showing an example in which a VDD applied to pixel lines in a sensing phase and a VDD applied to pixel lines in a driving phase are separate.

FIG. 13 is a view showing an example in which pixels on all pixel lines are driven by common VDD. FIG. 14 is a view showing an example in which a VDD applied to pixel lines in a sensing phase and a VDD applied to pixel lines in a driving phase are separate.

As shown in FIG. 13, a common VDD output from the power circuit 150 is supplied through an input resistance Rin to sub-pixels 132 that operate in the driving phase. Also, the common VDD is supplied through the input resistance Rin to sub-pixels 131 that operate in the reset phase, sensing phase, or data writing phase. In this case, IR drop of the VDD applied to the sub-pixels 131 that operate in the reset phase, sensing phase, or data writing phase is increased by the sub-pixels 132 operating in the driving phase. In FIG. 13, "Idr" is the current flowing through the driving elements of the sub-pixels 132 operating in the driving phase, and "Isc" is the current flowing through the driving elements of the sub-pixels 131 operating in the reset phase, sensing phase, or data writing phase. Provided that Isc=Idr, the voltage Vsc supplied to the sub-pixels 131 shown in FIG. 13 is Vsc=VDDPMIC−(Isc*N*M*number of sub-pixels*Rin). Here, VDDPMIC is the VDD output from the power circuit 150. N*M is the resolution of the display panel 100.

Referring to FIG. 14, the power circuit 150 supplies VDD2 to the second VDD line 32 in the reset phase, sensing phase, or data writing phase by using a VDD switching element. When VDD2 is supplied to sub-pixels arranged on a pixel line through the second VDD line 32, VDD1 for the driving phase is supplied to the sub-pixels on the other pixel lines, other than the pixel line to which VDD2 is applied.

As shown in FIG. 14, VDD2 output from the power circuit 150 is supplied through a first input resistance Rin1 to sub-pixels 141 that operate in the reset phase, sensing phase, or data writing phase. VDD1 for the driving phase output from the power circuit 150 is supplied through a second input resistance Rin2 to sub-pixels 142 that operate in the driving phase. Provided that Isc=Idr, the voltage Vsc supplied to the sub-pixels 141 shown in FIG. 14 is Vsc=VDDPMIC−(Isc*Rin1). Thus, as seen from FIG. 14, there is no voltage drop caused by IR drop since VDD2 supplied to the sub-pixels 141 is not affected by other sub-pixels.

Figure 15:
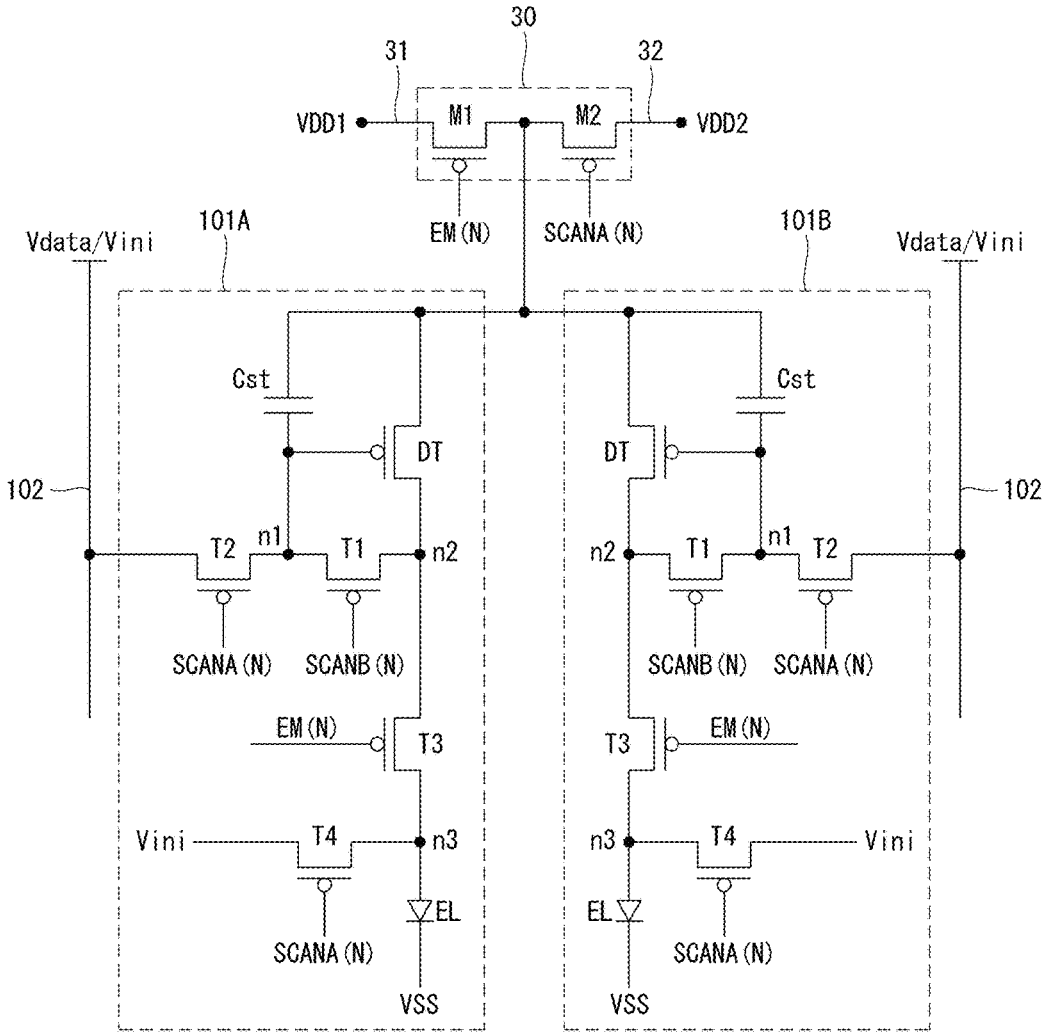
FIG. 15 is a circuit diagram showing a VDD switching circuit and a pixel circuit according to an exemplary embodiment of the present disclosure.
Figure 16:
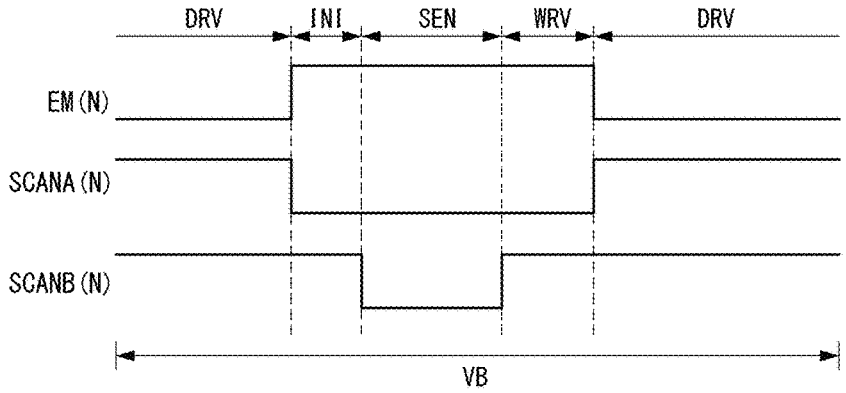
FIG. 16 is a waveform diagram showing a sub-pixel sensing phase in a vertical blanking interval.
Figure 17:
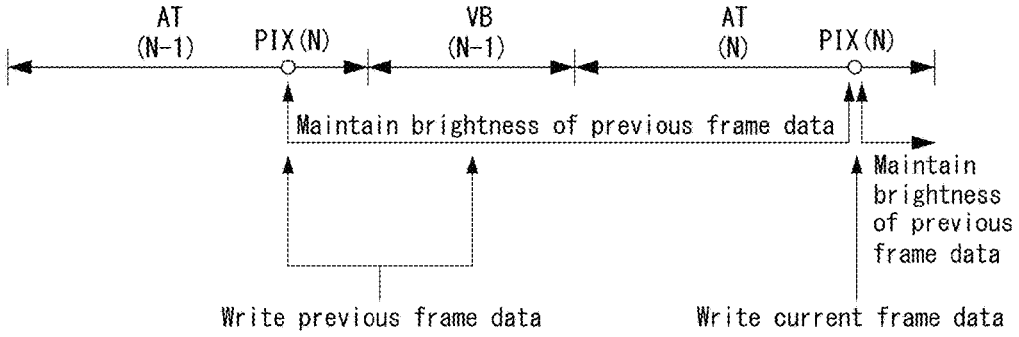
FIG. 17 is a view showing an example in which previous frame data is re-written to a sub-pixel in the vertical blanking interval.
Figure 18:
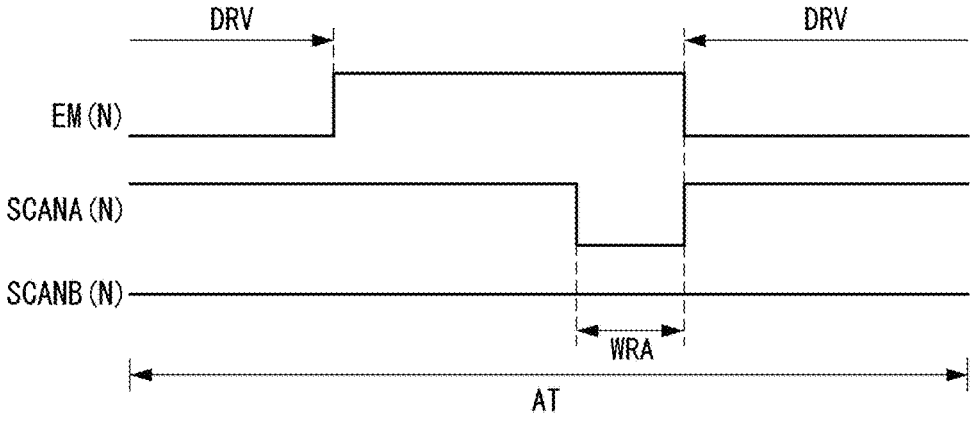
FIG. 18 is a waveform diagram showing a sub-pixel data writing phase in an active period.

FIG. 15 is a circuit diagram showing a VDD switching circuit and a pixel circuit according to an exemplary embodiment of the present disclosure. FIG. 16 is a waveform diagram showing a sub-pixel sensing phase in a vertical blanking interval. FIG. 17 is a view showing an example in which previous frame data is re-written to a sub-pixel in the vertical blanking interval. FIG. 18 is a waveform diagram showing a sub-pixel data writing phase in an active period.

Referring to FIGS. 15 to 18, the VDD switching circuit 30 comprises first and second switching elements M1 and M2 connected to neighboring first and second sub-pixels 101A and 101B. The first and second sub-pixels 101A and 101B are connected to different data lines 102 and are connected in common to a plurality of gate lines 41 to 43.

In the present disclosure, the VDD switching elements M1 and M2 of the VDD switching circuit 30 are shared by the first and second sub-pixels 101A and 101B, so the number of switching elements required for the VDD switching circuit 30 can be reduced and the area required for the VDD switching circuit 30 can be reduced.

The pixel circuit comprises a light-emitting element EL, a driving element DT, a storage capacitor Cst, and a plurality of switching elements T1 to T4. The VDD switching elements M1 and M2 and the switching elements T1 to T4 and driving elements DT of the pixel circuit may be implemented by PMOS TFTs.

The light-emitting elements EL of the sub-pixels emit light in the driving phase DRV in which current Ids flows through the driving elements DT. The driving phase DRV occupies most of 1 frame, except the data writing phase WRA of the active period AT and the reset phase INI, sensing phase SEN, and data writing phase WRV of the vertical blanking interval VB.

As shown in FIG. 16, the vertical blanking interval VB comprises a reset phase INI, a sensing phase SEN, a data writing phase WRV, and a driving phase DRV. As shown in FIG. 18, the active period AT comprises a data writing phase WRA and a driving phase DRV. In the data writing phase WRA of a sub-pixel sensed in the active period AT subsequent to the vertical blanking interval VB, current frame data is written to the sub-pixel. On the other hand, in the data writing phase WRV of the vertical blanking interval VB, previous frame data is re-written to the sub-pixel. This means that the data written to the sub-pixel sensed in the previous active period AT and the data written in the vertical blanking interval VB are the same.

The first VDD switching element M1 turns on in the driving phase DRV in response to an EM signal EM(N). The first VDD switching element M1 connects the first VDD line 31 to the sub-pixels of the driving phase DRV and supplies VDD1 to the driving elements DT and storage capacitors Cst of the sub-pixels. The first VDD switching element M1 comprises a gate connected to a third gate line 43 to which the EM signal EM(N) is applied, a first electrode connected to the first VDD line 31, and a second electrode connected to the driving elements DT and storage capacitors Cst of the pixel circuits.

The second VDD switching element M2 turns on in response to a first scan signal SCANA(N). The second VDD switching element M2 connects the second VDD line 32 to the sub-pixels of the data writing phase or sensing phase and supplies VDD2 to the driving elements DT and storage capacitors Cst of the sub-pixels. The second VDD switching element M2 comprises a gate connected to the first gate line 41 to which the first scan signal SCANA(N) is applied, a first electrode connected to the second VDD line 32, and a second electrode connected to the driving elements DT and storage capacitors Cst of the pixel circuits.

The light-emitting element EL of a pixel circuit may be implemented as an OLED. The OLED comprises organic compound layers formed between an anode and a cathode. The organic compound layers may comprise, but not limited to, a hole injection layer HIL, a hole transport layer HTL, an emission layer EML, an electron transport layer ETL, and an electron injection layer EIL. When the OLED is turned on, a hole passing through the hole transport layer HTL and an electron passing through the electron transport layer ETL move to the emission layer EML, forming an exciton. As a result, the emission layer EML generates visible light. The OLED emits light by an electric current that is generated in the driving phase DRV and regulated by the gate-source voltage Vgs of the driving element DT. The anode of the OLED is connected to the third and fourth switching elements T3 and T4 via a third node n3. The cathode of the OLED is connected to a VSS electrode to which VSS is applied. In the driving phase, the current path of the OLED is switched by the first VDD switching element M1 and the third switching element T3 of the pixel circuit.

The first electrode of the storage capacitor Cst is connected to the second VDD line 32 through the VDD switching circuit 30 in the data writing phase and sensing phase, and is connected to the first VDD line 31 through the VDD switching circuit 30 in the driving phase. The second electrode of the storage capacitor Cst is connected to a gate of the driving element DT, a first electrode of the first switching element T1, and a second electrode of the second switching element T2 via a first node n1.

The first switching element T1 turns on in response to a second scan signal SCANB(N) in the sensing phase. The first switching element T1 connects the first node n1 to a second node n2 in the sensing phase. The second node n2 is connected to the second electrode of the first switching element T2, a second electrode of the driving element D2, and a first electrode of the third switching element T3. The first switching element T1 comprises a gate connected to the second gate line 42 to which the second scan signal SCANB (N) is applied, a first electrode connected to the first node n1, and a second electrode connected to the second node n2.

The second switching element T2 turns on in response to the first scan signal SCANA(N) in the data writing phase WRA of the active period AT and the reset phase INI, sensing phase SEN, and data writing phase WRV of the vertical blanking interval VB, and connects the data line 102 to the first node n1. The second switching element T2 comprises a gate connected to the first gate line 41 to which the first scan signal SCANA(N) is applied, a first electrode connected to the data line 102, and a second electrode connected to the first node n1.

The third switching element T3 turns on in response to the EM signal EM(N) in the driving phase DRV and connects the second node n2 to the third node n3. The third switching element T3 comprises a gate connected to the third gate line 43 to which the EM signal EM(N) is applied, a first electrode connected to the second node n2, and a second electrode connected to the anode of the light-emitting element EL via the third node n3.

The fourth switching element T4 turns on in response to the first scan signal SCANA(N) in the data writing phase WRA of the active period AT and the reset phase INI, sensing phase SEN, and data writing phase WRV of the vertical blanking interval VB, and connects the Vini wiring to the third node n3. The fourth switching element T4 connects the Vini wiring to the anode of the light-emitting element EL in the reset phase INI, sensing phase SEN, and data writing phases WRA and WRV to discharge the parasitic capacitance of the light-emitting element EL, thereby preventing motion blur of the sub-pixel. The fourth switching element T4 comprises a gate connected to the first gate line 41, a first electrode connected to the Vini wiring, and a second electrode connected to the third node n3.

Referring to FIGS. 16 and 17, in the vertical blanking interval VB, the first scan signal SCANA(N) is generated as a pulse of gate-on voltage that defines the reset phase INI, sensing phase SEN, and data writing phase WRV. In the vertical blanking interval VB, the second scan signal SCANB(N) is generated as a pulse of gate-on voltage that defines the sensing phase SEN. The second scan signal SCANB(N) is generated at gate-on voltage only in the sensing phase SEN and kept at gate-off voltage during the remaining time of the vertical blanking interval VB and during the active period AT. The EM signal EM(N) is generated as a pulse of gate-off voltage in the reset phase INI, sensing phase SEN, and data writing phase WRV of the vertical blanking interval VB and generated at gate-on voltage in the driving phase DRV.

Figure 21:
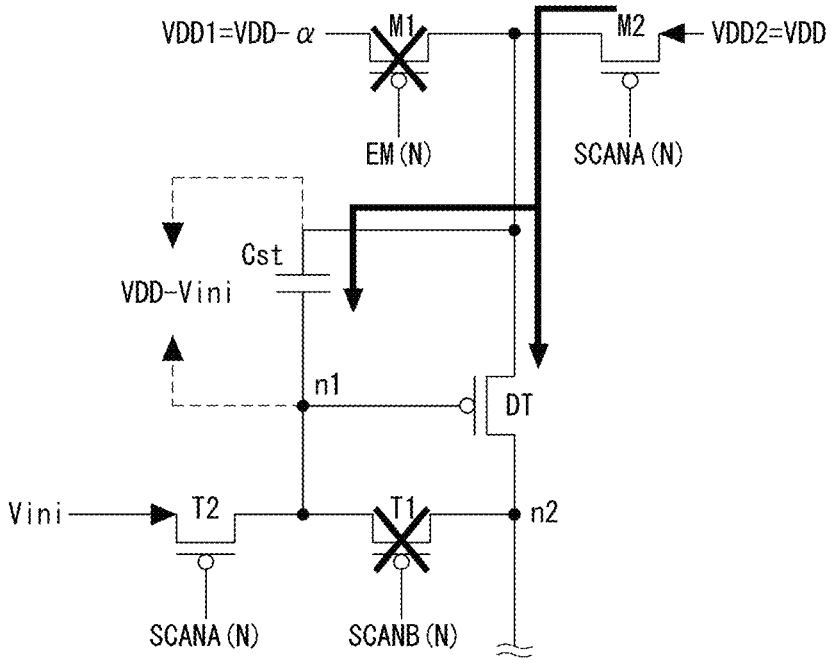
FIG. 21 is a circuit diagram showing how a pixel circuit works in the reset phase and sensing phase of the vertical blanking interval.
Figure 21:
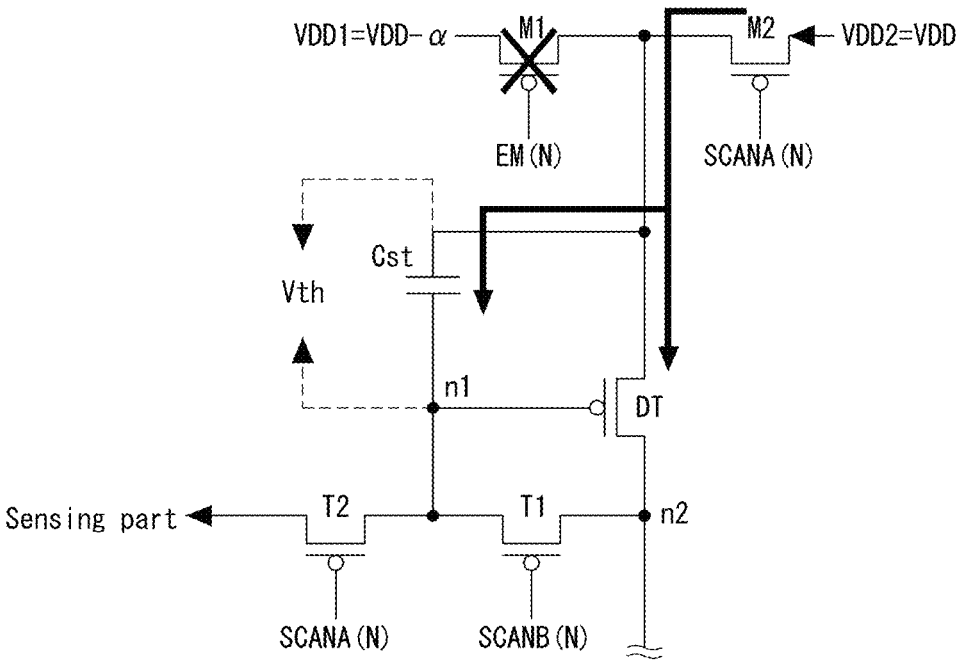

In the reset phase INI, as shown in FIG. 21, the second VDD switching element M2 and the second switching element T2 and fourth switching element T4 of the pixel circuit turn on in response to the first scan signal SCANA (N). In the reset phase INI, Vini is supplied to the data line 102. Accordingly, in the reset phase INI, the first electrode of the storage capacitor Cst of the pixel circuit and the first electrode of the driving element DT are reset to VDD2 minus IR drop, and the first node n1 and the third node n3 are reset to Vini.

In the sensing phase SEN, as shown in FIG. 21, the second VDD switching element M2 and the first, second, and fourth switching elements T1, T2, and T4 of the pixel circuit turn on in response to the scan signals SCANA(N) and SCANB (N). In the sensing phase INI, VDD2 minus IR drop is supplied to the first electrode of the storage capacitor Cst of the pixel circuit and the first electrode of the driving element DT, and they remain turned on until the gate-source voltage Vgs of the driving element DT reaches a threshold voltage Vth and the threshold voltage Vth is stored in the storage capacitor Cst. The threshold voltage Vth of the driving element DT which is sensed in the sensing phase SEN is converted to digital data in the sensing part 20 through the first and second switching elements T1 and T2 and the data line 102, and then transmitted to the compensation part 131.

In the data writing phase WRV, the second VDD switching element M2 and the first, second, and fourth switching elements T1, T2, and T4 of the pixel circuit turn on in response to the first scan signal SCANA(N). In the data writing phase WRV, the data voltage Vdata of the previous frame is supplied to the data line 102 and the input image's data is written to the sub-pixel. In the data writing phase WRV, a data voltage Vdata+Vth, which is produced by compensating the data voltage Vdata by an amount equal to the threshold voltage Vth of the driving element DT, is stored in the storage capacitor Cst. In the data writing phase WRV, Vgs of the driving element DT changes to the voltage Vdata+Vth stored in the storage capacitor Cst. In the data writing phase WRV, the data written to the sub-pixel is the same as the previous frame data of the previous active period. This data is the previous frame data as shown in FIG. 17.

In the driving phase DRV of the vertical blanking interval VB, the first VDD switching element M1 and the third switching element T3 of the pixel circuit turn on in response to the EM signal EM(N). In this instance, the driving element DT generates current Ids by the gate-source voltage Vgs. The light-emitting element EL turns on and emits light by the current Ids from the driving element DT. VDD1 supplied to the pixel circuit in the driving phase DRV comprises a voltage drop α caused by IR drop. In the driving phase DRV, when VDD1−α is applied to the first electrode of the storage capacitor Cst and the first electrode of the driving element DT, the voltage at the first node n1 decreases by α, resulting in no change in Vgs of the driving element DT. Thus, the light-emitting element EL is driven without the effect of IR drop in the driving phase DRV.

Referring to FIG. 17, previous frame data is written to the sub-pixel PIX(N) during an (N−1)th active period VB(N−1). The sub-pixel PIX(N) is an arbitrary sub-pixel to be sensed in the vertical blanking interval VB. After data is written to all the pixels during the (N−1)th active period AT(N−1), when the sub-pixel PIX(N) is reset and then sensed in an (N−1)th vertical blanking interval VB(N−1), the data is erased from the sub-pixel PIX(N) and therefore the sub-pixel PIX(N) turns off. During 1 frame in which the vertical blanking interval VB(N−1) is present, the same data as the previous frame data should be re-written to the sub-pixel PIX(N) after the sensing phase SEN of the vertical blanking interval VB(N−1) so that the brightness of the sensed sub-pixel PIX(N) may remain constant.

Referring to FIG. 18, the active period AT comprises a data writing phase WRA defined by the first scan signal SCANA(N) and a driving phase WRA defined by the EM signal EM(N).

Figure 19:
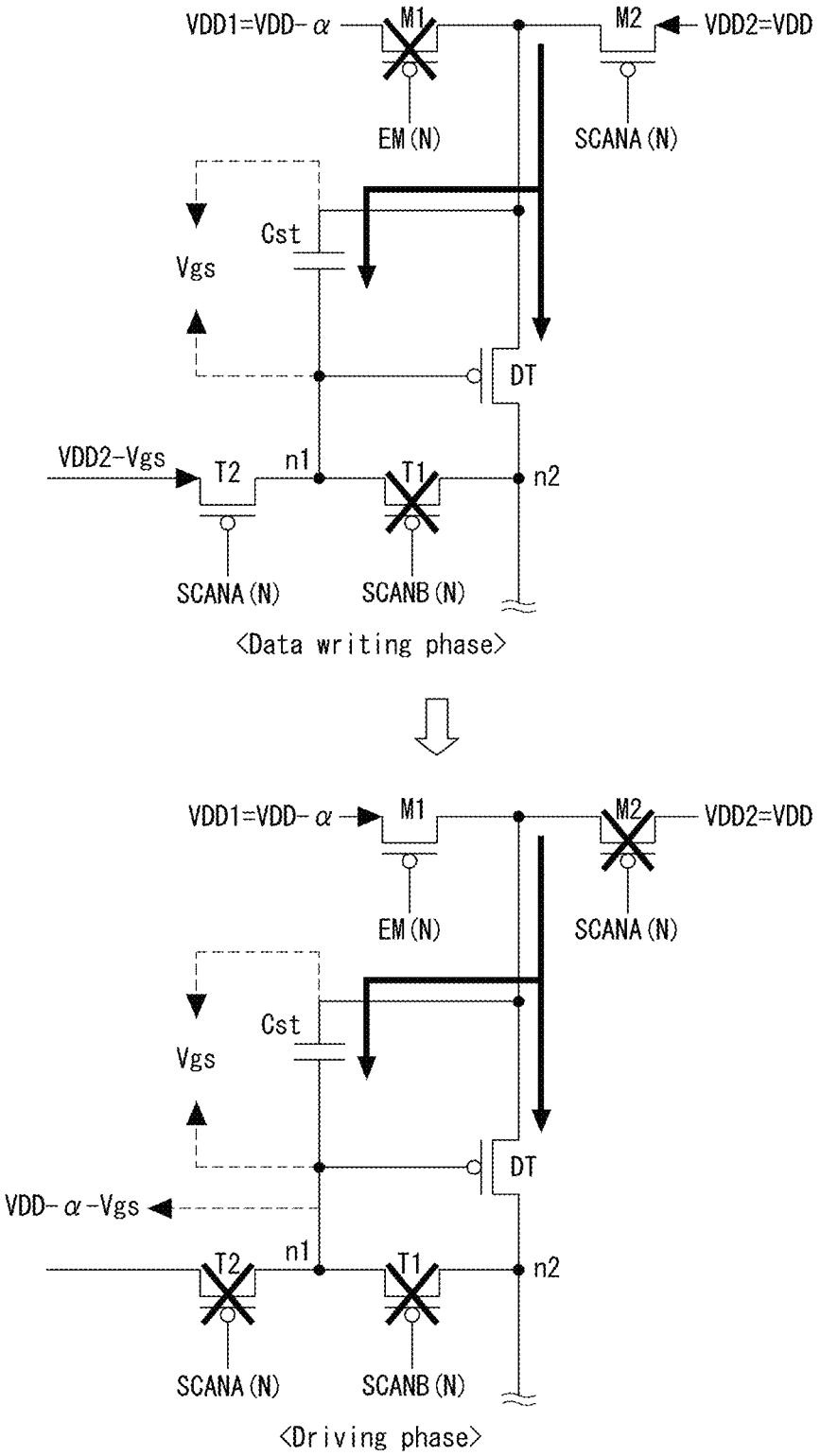
FIG. 19 is a circuit diagram showing the data writing phase and driving phase of the active period.

In the active period AT, the first scan signal SCANA(N) is generated as a pulse of gate-on voltage that defines a data writing phase WRA of approximately 1 horizontal time. In the data writing phase WRA, the second scan signal SCANB (N) and the EM signal EM(N) are gate-off voltage. The second scan signal SCANB(N) is kept at gate-off voltage during the active period AT. As shown in FIG. 19, the second VDD switching element M2 and the second switching element T2 turn on in the data writing phase WRV. In the data writing phase WRV, the data voltage Vdata of current frame data is supplied to the data line 102 and data is written to the sub-pixel. The data voltage Vdata is equal to VDD−(DATA−Vth). DATA is a voltage corresponding to a gray level in data. Therefore, VDD2 is applied to the storage capacitor Cst and the first electrode of the driving element DT, and the data voltage Vdata is supplied to the first node which is connected to the second electrode of the storage capacitor Cst and the gate of the driving element.

In the driving phase DRV of the active period AT, as shown in FIG. 19, the first VDD switching element M1 and the third switching element T3 turn on in response to the EM signal EM(N). In this instance, the driving element DT generates current Ids by the gate-source voltage Vgs. The light-emitting element EL turns on and emits light by the current Ids from the driving element DT. VDD1 supplied to the pixel circuit in the driving phase DRV comprises a voltage drop α caused by IR drop. In the driving phase DRV, when VDD1−α is applied to the first electrode of the storage capacitor Cst and the first electrode of the driving element DT, the voltage at the first node n1 decreases by α, resulting in no change in Vgs of the driving element DT. Thus, the light-emitting element EL is driven without the effect of IR drop in the driving phase DRV.

Figure 20:
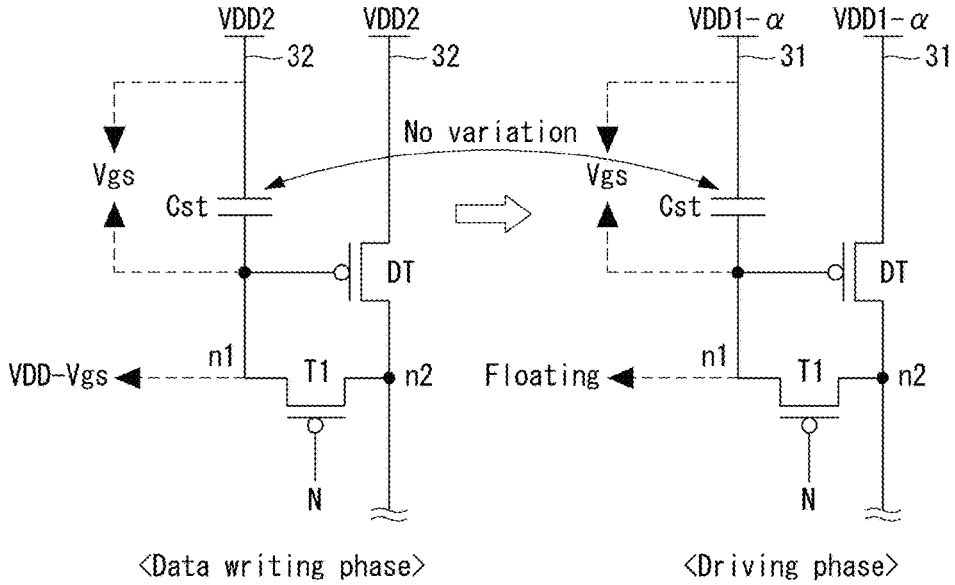
FIG. 20 is a view showing a VDD applied to a pixel circuit in the data writing phase and the driving phase and the voltage of the storage capacitor.

FIG. 20 is a view showing a VDD applied to a pixel circuit in the data writing phase WRA or WRB and the driving phase DRV and the voltage of the storage capacitor.

Referring to FIG. 20, VDD2=VDD is applied to the first electrode of the storage capacitor Cst and the first electrode of the driving element DT, and Vdata=VDD−(DATA−Vth) is applied to the second electrode of the storage capacitor Cst. Hence, the voltage of the storage capacitor Cst is Vgs=DATA+Vth.

In the driving phase DRV, VDD1=VDD−α, which is VDD minus a voltage drop α caused by IR drop, is applied to the first electrode of the storage capacitor Cst and the first electrode of the driving element DT, and the second electrode of the storage capacitor Cst floats because the first and second switching elements T1 and T2 are turned off. Since the first node n1 is floating, the second electrode voltage of the storage capacitor Cst changes by α when the first electrode voltage of the storage capacitor Cst changes by α. Accordingly, the potential difference between two ends of the storage capacitor Cst is maintained even if VDD changes in the driving phase DRV. Thus, Vgs is kept at the same voltage as stored in the sensing phase.

Figure 22:
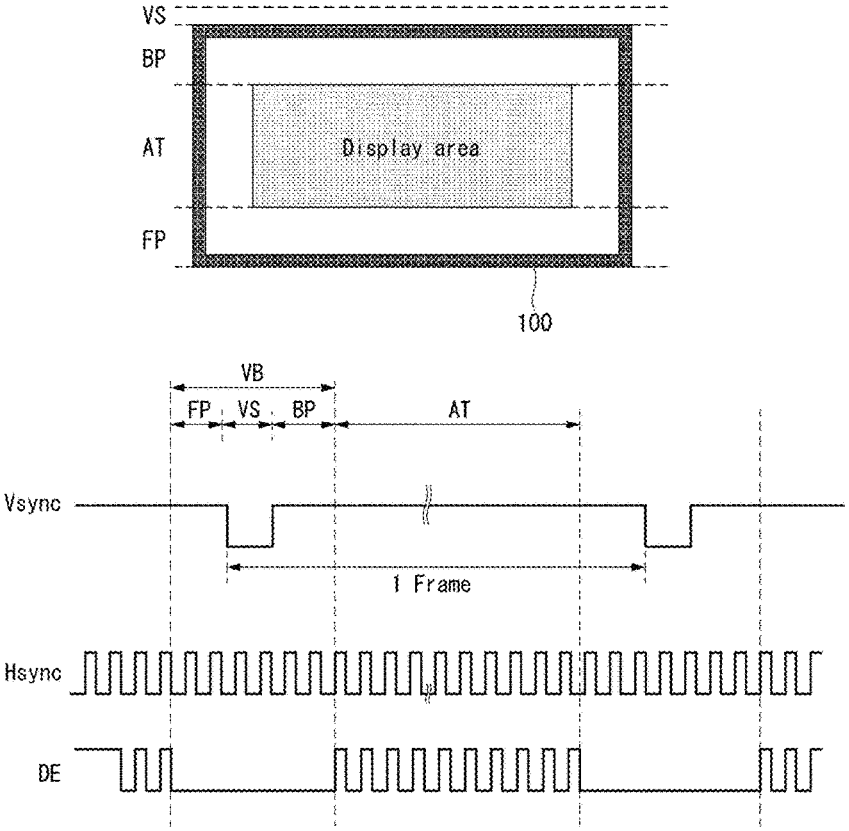
FIG. 22 is a view showing the active period and the vertical blanking interval.

FIG. 22 is a view showing the active period and the vertical blanking interval according to a display timing standard by VESA (Video Electronics Standards Association).

Referring to FIG. 22, a vertical synchronization signal Vsync defines 1 frame. A horizontal synchronization signal Hsync defines 1 horizontal time. A data enable signal DE defines the duration of valid data comprising pixel dta to be displayed on the screen.

The data enable signal DE is synchronized with the valid data to be displayed on the pixel array of the display panel 100. 1 pulse interval of the data enable signal DE is 1 horizontal time, and the high logic part of the data enable signal DE represents the data input timing of 1 pixel line. 1 horizontal time is the time required to write data to 1 pixel line of pixels on the display panel 100.

The timing controller 130 receives the data enable signal DE and data of an input image during the active period AT. The data enable signal DE and the input image data are not provided during the vertical blanking interval VB. During the active period AT, 1 frame of data to be written to all the pixels is received by the timing controller 130. 1 frame is the sum of the active period AT and the vertical blanking interval VB.

As can be seen from the data enable signal DE, no input data is received by the display device during the vertical blanking interval VB. The vertical blanking interval VB comprises a vertical sync time VS, a vertical front porch FP, and a vertical back porch BP. The vertical sync time VS is the time from the falling edge of Vsync to the rising edge, which represents the start (or end) timing of a picture. The vertical front porch FP is the time between the falling edge of the last DE, which is the data timing of the final line of one frame, and the start of the vertical blanking interval VB. The vertical back porch BP is the time between the end of the vertical blanking interval VB and the rising edge of the first DE, which is the data timing of the first line of one frame.

As described above, in the present disclosure, driving voltage VDD is divided into VDD=VDD1 for the driving phase and VDD=VDD2 for the sensing phase and data writing phase, and variations in the electrical characteristics of sub-pixels are compensated for by external compensation. In the present disclosure, when data is written to the sub-pixels in the active period and the electrical characteristics of the sub-pixels are sensed in the vertical blanking interval, VDD(=VDD1) is applied to the sub-pixels. Accordingly, the electroluminescence display of the present disclosure prevents variations in the gate-source voltage Vgs of the driving elements of individual sub-pixels without the effect of IR drop in the sensing and data writing phases, and is able to accurately sense the electrical characteristics of the driving elements of individual sub-pixels since there is no effect of IR drop in the sensing phase.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display panel, which displays frame data during a frame period including an active period and a blanking interval, and modulates data of an input image based on a result of sensing electrical characteristics of pixels in the blanking interval, the display panel comprising:

a sub-pixel, the sub-pixel including a light-emitting element and a driving element configured to drive the light-emitting element to emit light based on a current in the driving element during a driving phase; and a power switching circuit configured to supply a first driving voltage to the sub-pixel during the driving phase in the active period and the blanking interval, and supply a second driving voltage to the sub-pixel during a data writing phase of the active period and during resetting, sensing, and data writing phases of the blanking interval.

2. The display panel of claim 1, wherein the first driving voltage is supplied to a first power line, and the second driving voltage is supplied to a second power line which is separate from the first power line.

3. The display panel of claim 1, wherein the sub-pixel further includes a capacitor connected to the driving element, the first driving voltage is supplied to a first electrode of the capacitor and a first electrode of the driving element during the driving phase of the active period and blanking interval, and the second driving voltage is supplied to the first electrode of the capacitor during the reset, sensing, and data writing phase of the blanking interval, wherein a second electrode of the capacitor of the sub-pixel is connected to a gate of the driving element via a first node, and the first electrode of the driving element is connected to the first electrode of the capacitor and the second electrode of the driving element is connected to a second node.

4. The display panel of claim 3, further comprising:

a first power line to which the first driving voltage is supplied, and which is connected in common to sub-pixels of all of a plurality of pixel lines; and a plurality of second power lines to which the second driving voltage is supplied, and which are separated between the pixel lines.

5. The display panel of claim 4, wherein the power switching circuit comprises:

a first pixel driving voltage switching element that turns on in the driving phase in response to an emission switching signal defining a duration of the driving phase and connects the first power line to the sub-pixel; and a second pixel driving voltage switching element that turns on in response to a first scan signal defining a duration of the data writing phase of the active period and durations of the reset, sensing, and data writing phases of the blanking interval and connects the first power line to the sub-pixel.

6. The display panel of claim 5, wherein the sub-pixel further comprises:

a first switching element that turns on in response to a second scan signal defining a duration of the sensing phase and connects the first node to the second node;

a second switching element that turns on in response to the first scan signal and connects a data line to the first node;

a third switching element that turns on in response to the emission switching signal and connects the second node to a third node; and a fourth switching element that turns on in response to the first scan signal and connects a third power line, to which a predetermined reset voltage is applied, to the third node, wherein the third node is connected to the third switching element, the fourth switching element, and an anode of the light-emitting element, and a data voltage of the input image is supplied to the data line during the data writing phase and the reset voltage is supplied to the data line during the reset phase.

7. The display panel of claim 1, wherein, in the data writing phase of the blanking interval and the data driving phase of a previous active period, a same previous frame data is written to a sub-pixel to be sensed in the blanking interval, and in the data writing phase of a next active period, current frame data is written to the sensed sub-pixel.

8. An electroluminescence display, comprising:

a display panel, which displays frame data during a frame period including an active period and a blanking interval, and modulates data of an input image based on a result of sensing electrical characteristics of pixels in the blanking interval, the display panel including:

a sub-pixel, the sub-pixel including a light-emitting element and a driving element configured to drive the light-emitting element to emit light based on a current in the driving element during a driving phase; and a power switching circuit configured to supply a first driving voltage to the sub-pixel during the driving phase in the active period and the blanking interval, and supply a second driving voltage to the sub-pixel during a data writing phase of the active period and during reset, sensing, and data writing phases of the blanking interval.

9. The electroluminescence display of claim 8, wherein the display panel includes:

first and second sub-pixels that are connected to different data lines and are connected in common to first, second, and third gate lines;

a data driver configured to supply a data voltage of the input image to the data lines during the data writing phase of the active period and the data writing phase of the blanking interval, and supply a reset voltage to the data lines during the reset phase; and a gate driver configured to supply the first gate line with a first scan signal defining a duration of the data writing phase of the active period and durations of the reset, sensing, and data writing phases of the blanking interval, supply the second gate line with a second scan signal defining a duration of the sensing phase, and supply the third gate line with an EM signal defining a duration of the driving phase.

10. The electroluminescence display of claim 8, further comprising a power circuit that outputs the first driving voltage and the second driving voltage, the power circuit comprising a first output terminal that outputs the first driving voltage and a second output terminal that outputs the second driving voltage, wherein the first and second driving voltages are output from the power circuit at a same voltage level.

11. The electroluminescence display of claim 8, further comprising a power circuit that outputs the first driving voltage and the second driving voltage, wherein the power circuit outputs a single driving voltage to a single wire through a single output channel, wherein the single wire is divided into first and second branch wires, the first driving voltage is supplied to the sub-pixels through the first branch wire, and the second driving voltage is supplied to the sub-pixels through the second branch wire.

12. The electroluminescence display of claim 8, further comprising:

a first power line to which the first driving voltage is supplied, and which is connected in common to sub-pixels of all of a plurality of pixel lines; and a plurality of second power lines to which the second driving voltage is supplied, and which are separated between the pixel lines and connected to the sub-pixels, wherein, when the second driving voltage is supplied to sub-pixels arranged on a single pixel line through pixel driving voltage lines, the first driving voltage is supplied to the sub-pixels on other pixel lines that are different from the single pixel line.

* * * * *